US005311999A

United States Patent [19]

Malow et al.

[11] Patent Number: 5,311,999

[45] Date of Patent: May 17, 1994

[54] METHOD OF DISTRIBUTING PACKAGES OR THE LIKE

[75] Inventors: Siegmar Malow; Michael Pausinger; Albert Glade; Hubert Gitschier, all of Constance, Fed. Rep. of Germany

[73] Assignee: Licentia Patent-Verwaltungs-GmbH, Frankfurt am Main, Fed. Rep. of Germany

[21] Appl. No.: 126,436

[22] PCT Filed: Dec. 19, 1990

[86] PCT No.: PCT/EP90/02234

§ 371 Date: Aug. 23, 1991

§ 102(e) Date: Aug. 23, 1991

[87] PCT Pub. No.: WO91/09688

PCT Pub. Date: Jul. 11, 1991

Related U.S. Application Data

[63] Continuation of Ser. No. 752,469, Aug. 23, 1991, abandoned.

[30] Foreign Application Priority Data

Dec. 23, 1989 [DE] Fed. Rep. of Germany ..... 3942932

[51] Int. Cl.[5] ..... B07C 5/00

[52] U.S. Cl. ..... 209/583; 209/587; 209/939; 382/8; 382/48; 235/470; 348/91

[58] Field of Search ..... 209/3.3, 546, 547, 583, 209/584, 587, 939; 358/93, 101, 108, 183; 382/8, 48, 61; 235/383, 470, 471

[56] References Cited

U.S. PATENT DOCUMENTS

| | | | |
|---|---|---|---|
| 3,180,988 | 4/1965 | Burkhardt et al. . | |
| 3,674,924 | 7/1972 | Fischer et al. | 358/93 |
| 3,846,753 | 11/1974 | Spanjeisberg . | |
| 3,868,478 | 8/1975 | Zeenkor | 358/93 |
| 4,065,343 | 12/1977 | Stumpe | 209/3.3 X |
| 4,691,231 | 9/1987 | Fitzmarris et al. | 209/939 X |
| 4,776,464 | 10/1988 | Miller et al. | 209/3.3 |
| 4,778,060 | 10/1988 | Wessner, Jr. | 209/3.3 |
| 4,783,825 | 11/1988 | Hirose et al. | 209/584 X |
| 4,992,649 | 2/1991 | Mampe et al. | 209/546 X |
| 5,065,237 | 11/1991 | Tsikos et al. | 358/101 |
| 5,148,275 | 9/1992 | Blatter et al. | 358/183 X |

FOREIGN PATENT DOCUMENTS

| | | |
|---|---|---|
| 2055837 | 6/1971 | Fed. Rep. of Germany . |
| 1270801 | 4/1972 | United Kingdom . |

*Primary Examiner*—D. Glenn Dayoan
*Assistant Examiner*—Tuan Nguyen
*Attorney, Agent, or Firm*—Spencer, Frank & Schneider

[57] ABSTRACT

In a method of distributing packages according to addresses, headings or the like applied to their surfaces by means of a separating and conveying device, it is provided that along a conveying path all surface portions of each previously separated package are scanned optically, for each package images are obtained from the surface portions of the package and, for further evaluation, the images are displayed simultaneously or approximately simultaneously. For each package, one or a plurality of the images are selected, and each selected image is assigned a sorting information for the distribution of the package corresponding to that image.

15 Claims, 1 Drawing Sheet

METHOD OF DISTRIBUTING PACKAGES OR THE LIKE

This application is a continuation of application Ser. No. 07/752,469, filed Aug. 23, 1991, now abandoned.

BACKGROUND OF THE INVENTION

The present invention relates to a method and to an apparatus for distributing packages or the like according to characters applied to their surfaces.

Already known from DE-AS [German Published Patent Application] 2,055,837 is a sorting system for postal packages and the like, the system including an intake conveyor and a sorting station. To sort and distribute the postal packages according to different address informations, this publication provides that the packages are supplied in random order to the sorting station, are there visually checked by operators and are distributed in a suitable manner depending on the result of the check, that is, they are transferred to the appropriate transporting devices. The performance of the visual check in this prior art sorting system requires the respective package to be manually turned and flipped over until the surface bearing the applied address has been located. For further distribution, the operators must then read the address and the postal code or delivery zone, respectively, must be determined for each package.

The drawbacks of such a sorting system are, in particular, the fact that, on the average, the packages must be manually flipped over and turned repeatedly in a time consuming manner until the address can be read and the obtained address information must be processed further in a complicated manner. The drawback of a system employing automatic flipping and turning of the packages for positioning the address is the high structural and control expenditures required for this purpose.

SUMMARY OF THE INVENTION

It is an object of the present invention to improve the prior art and, in particular, to provide a method and an apparatus for distributing packages or the like in which the address information is obtained substantially automatically and there is only little positioning or movement of the packages during the obtaining of the address information, while further processing of the obtained address information is easier.

This is accomplished according to the invention, according to which, briefly stated, the method of distributing multisurface packages according to an address applied to a package surface includes the following steps: individually conveying the packages in a transporting direction along a conveying path and optically scanning each surface of each package, including an optical scanning of an underside of each package through a gap in the conveying path. The scanning step includes rough-scanning at least some of the package surfaces. Thereafter, at least approximately simultaneously, an image of all package surfaces of each package is obtained and for each package, a package surface based on all surface images is selected, and the selected package surface is fine-scanned. Then an at least partial image of the selected surface is obtained and to the image of the selected package surface there is assigned a sorting information for distributing the package corresponding to the image. The invention is here based on the concept that, after separation and alignment of the packages so that one edge is oriented in a defined manner relative to the transporting direction, positioning or movement of the packages in order to obtain the address information is not necessary if all surface portions of every package are scanned optically and images of all six surface portions are obtained. If the image of one surface portion includes a region containing address information (e.g., a sticker) this surface is evaluated further. This can be accomplished in that an image of greater resolution is obtained of the respective partial region of the surface in question (pickup field) and is fed to an automatic character recognition device and/or a video coding device or—if the resolution of the mentioned image is high enough—this image is fed to the above-mentioned devices. For further distribution and sorting, the detected addresses are assigned a distribution code, e.g. a postal code, which controls the subsequent distribution of the packages.

DESCRIPTION OF THE PREFERRED EMBODIMENT

Figure 1:
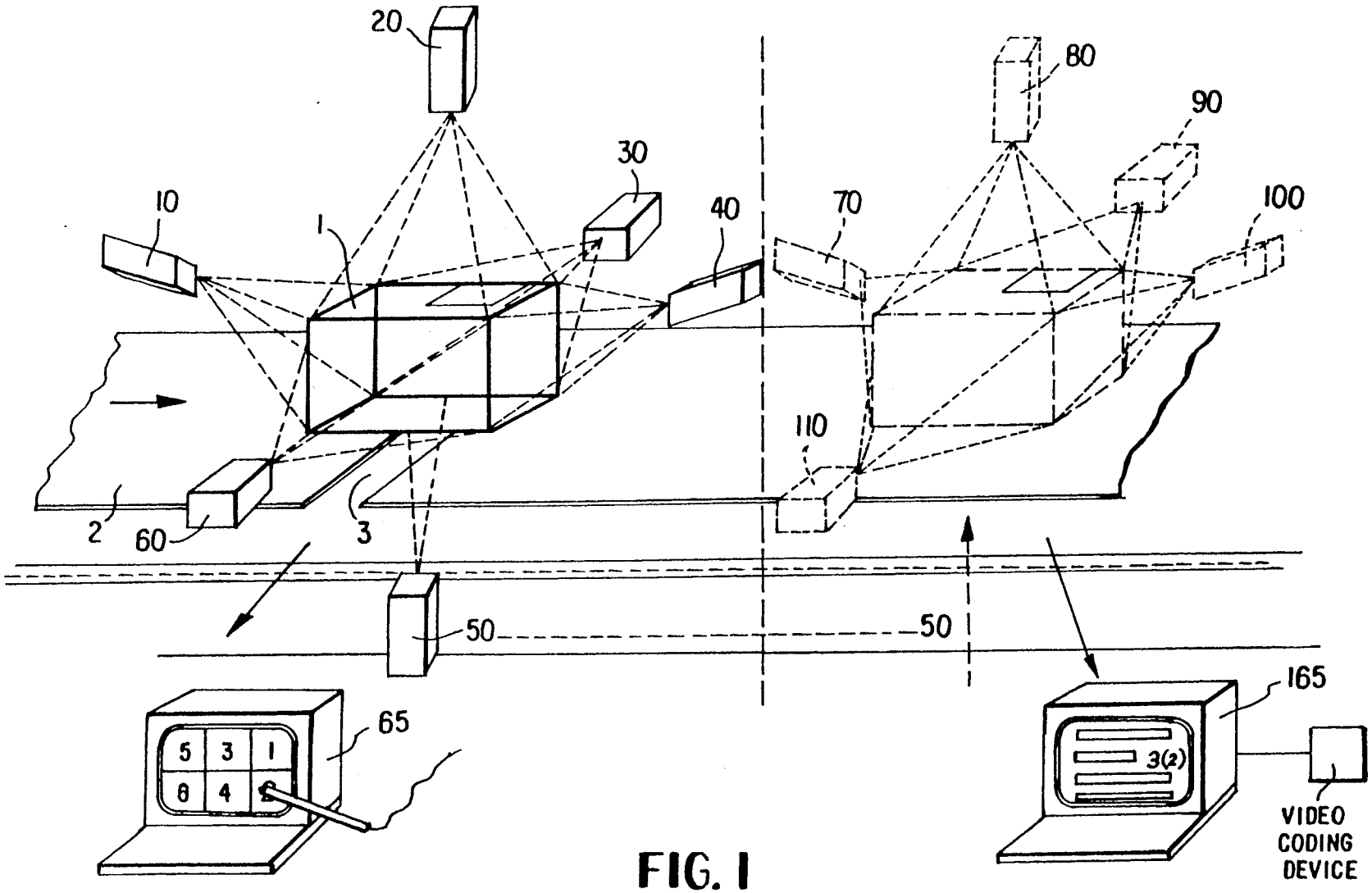
FIG. 1 is a schematic, perspective representation of an apparatus according to a preferred embodiment of the invention for determining the region containing address informations and for scanning the address on a package.

The apparatus according to FIG. 1 makes it possible to obtain address informations from characters applied to the surface of the package without the packages, which have already been separated and aligned, having to be positioned or moved.

The separation of the packages from the stream of packages and their alignment along an edge so that they attain a defined orientation with respect to the transporting direction can here be effected by suitable mechanical components, such as, for example, vibratory belts, combinations of conveyor belts operating at different speeds and dropping them off over edges. Preferably the packages are aligned along an edge parallel to the transporting direction.

In the apparatus according to the invention as illustrated in FIG. 1, a package 1 is moved along a conveying path 2 provided with a gap 3 of such small dimensions that it does not interfere with movement of the package over it. The package is scanned from six spatial directions by cameras 10, 20, 30, 40, 50 and 60, with camera 50 preferably being configured as a linear camera which scans the downwardly oriented surface portion of the package while the remaining five cameras which may be configured as standard planar cameras scan the five exposed sides of the package.

The images picked up by the cameras are displayed simultaneously on a monitor 65 having six partial image regions. An operator is able to simultaneously evaluate the six images of a package, that is, identify and mark the position of the address region on one of the partial monitors.

The following must be considered for further processing of the packages. The determination of the address location requires only low resolution images which, however, must cover the entire package surface in each case. On the other hand, the automatic detection of addresses present in the form of characters of the size produced by a typewriter requires a resolution of about eight to ten pixels per millimeter. If the same image that was used for determining the address location were to be used for the automatic character recognition, the maximum size of about 600/600/1000 mm (width-/height/length) of the packages to be sorted would thus require images having 6,000×10,000 pixels. Aside from linear cameras which, due to the vibrations of the packages on the transporting path, can be used only in a very limited way, image pickups of such a size are not available at present at justifiable expense. The apparatus according to FIG. 1 therefore employs a two-stage pickup of images with different resolutions, although one-stage processing of the packages is also possible if cameras with suitable resolution are employed. Cameras 10 to 60 initially pick up an image of a rough lateral resolution (rough scanning) which covers the entire package and this image is evaluated as described above to determine the location of the address. The evaluation may be effected as follows:

1. finger pointing on a touch screen;
2. light pen on a viewing screen;
3. mouse and digitizing pad or similar pointing device.

Solution 1. here has the advantage that the operator works only on the screen and not on an additional surface and need not employ any kind of instrument, but it has the drawback that it positions the address field relatively inaccurately. In contrast thereto, solutions 2. and 3. permit finer positioning.

The marking of the address and determination of the field to be picked up according to 2. and 3. may be effected in the following modes:

- marking of the center of the field to be picked up, with it being possible to give a completion report by displaying the selected field to be picked up on a monitor.
- marking two corners of the field to be picked up in which case the field to be picked up may be of variable size and shape;
- positioning a symbol on the heading field which coincides in size and shape with the field to be picked up.

The field to be picked up determines the section of the package surface from which an image is obtained with a fine lateral resolution to be evaluated for character recognition. For this purpose, cameras 70, 80, 90, 100 and 110 are provided which also permit the pickup of an image of the entire package without the package having to be positioned or moved. By means of an optomechanical system, the pickup windows of these cameras may be positioned as desired within the respective package surface, with the resolution of these cameras being selected so that it is suitable for automatic character recognition. A monitor 165 displays the image obtained from the fine-scanning.

After the rough scanning, the package is transported by the conveying device into the region for fine scanning. In the apparatus according to FIG. 1, the linear camera employed for rough scanning through gap 3 in order to scan the underside of the package may be selected so that it covers, with sufficient resolution for character recognition, the entire width of the package. The compressed image provided by the camera can then be utilized to evaluate the rough scanning while a section of this image in full resolution is utilized for automatic character recognition. This permits the omission of a camera for fine scanning. In another embodiment of the invention, not shown here, a further gap and an additional camera are provided for finely scanning the underside of the package. In any case, the location of the address region obtained from the rough scanning controls the selection of one of the six cameras and the positioning of its pickup window.

While in the above described embodiment of the apparatus the six images obtained from rough scanning are evaluated manually, in another embodiment this evaluation may also occur automatically. For this purpose, it is merely necessary to examine all six images obtained from the rough scanning for regions which coincide in a selection of features with the model of an address sticker or an address region on a package. Features of this type are, for example, the color contrast of an area compared to its surroundings, the gray value contrast of an area compared to its surroundings, the shape of this area, the type and number of dark regions within the area, its location with respect to other distinct objects and with respect to the outline of the package. According to known image recognition methods, the image most likely containing an address region can be selected automatically from the images obtained by rough scanning whereupon this region is subjected to fine scanning. In this first stage, the images may also already be supplied to an automatic character recognition device; fine scanning then takes place only if the images obtained by rough scanning are rejected by the character recognition device. The evaluation of the images obtained by fine scanning may then be effected, in addition to or as an alternative to the above-mentioned character recognition device, by one or several video coding devices. This is of particular advantage if packages having addresses that are legible to a different degree appear in a mixed arrangement so that the rejected addresses (those that cannot be read by machine) can be subjected to corrective coding.

After the evaluation of the images obtained by fine scanning, that is, after recognition of the addresses, known methods are employed to assign a distribution code which is also applied to the packages and which controls their further distribution in sorting devices that are not shown in detail here.

While in the above described embodiment of the invention employing six cameras for rough scanning and six or five for fine scanning, the packages need not again be moved after separation and alignment on the conveying path, further embodiments employing a smaller number of cameras require one or two turns or flips which are performed automatically by appropriate mechanisms.

We claim:

1. A method of distributing multisurface packages by a separating and conveying device according to an address applied to a package surface, comprising the following steps:

(a) individually conveying the packages in a transporting direction along a conveying path;

(b) optically scanning each surface of each package, including an optical scanning of an underside of each package through a gap in said conveying path; said scanning step including rough-scanning at least some of the package surfaces;

(c) based on step (b), obtaining, at least approximately simultaneously, an image of all package surfaces of each package on a single monitor having six partial image regions;

(d) selecting, for each package, a package surface based on all surface images obtained in step (c);

(e) fine-scanning the package surface selected in step (d);

(f) based on step (e), obtaining an at least partial image of the selected surface; and (g) assigning to the image of the selected package surface a sorting information for distributing the package corresponding to the image.

2. A method according to claim 1, wherein the images are displayed on one or a plurality of monitors for joint evaluation.

3. A method according to claim 1, wherein in the first step (b), a linear camera with high resolution scans the underside of the package through the gap in the conveying path.

4. A method according to claim 1, wherein still pictures of the rough scanning are employed.

5. A method according to claim 1, wherein the images from the rough scanning are supplied to an automatic character recognition device which evaluates the images and selects a surface portion for fine scanning only if the images obtained by rough scanning are rejected.

6. A method according to claim 1, wherein the image of the finely scanned surface is fed to an automatic character recognition device.

7. A method according to claim 6, wherein images rejected by the automatic character recognition device are fed to a video coding devices for the input of correct addresses.

8. A method according to claim 7, characterized in that sorting means which are electrically connected with the character recognition device sort the packages as a function of their addresses.

9. A method according to claim 7, wherein a code is associated with the address and is applied to the packages.

10. A method according to claim 1, wherein moving pictures of the rough scanning are used.

11. An apparatus for recognizing an address on a surface of multisurface packages; comprising (a) a conveyor for consecutively advancing the packages along a conveying path;

(b) a gap provided in the conveying path over which the packages are moved;

(c) optical scanning means for optically scanning all surfaces of each package; said optical scanning means including means for scanning an underside of each package through said gap; said optical scanning means including means for rough-scanning at least some of the package surfaces;

(d) displaying means for at least approximately simultaneously displaying images of all surfaces of each package; said displaying means being formed of a single monitor having six partial image regions; and (e) means for fine-scanning a region of a selected image and for obtaining an image of the region with a predetermined resolution.

12. An apparatus according to claim 11, said optical scanning means comprising six cameras for optically scanning all surface portions.

13. An apparatus according to claim 11, said means for scanning an underside comprising a linear camera with high resolution.

14. An apparatus according to claim 11, further in that automatic character recognition means are for the association of distribution codes with the addresses.

15. An apparatus according to claim 11, further comprising a video coding device for assigning distribution codes to the addresses.

* * * * *